US007143622B2

(12) United States Patent
Sucke et al.

(10) Patent No.: US 7,143,622 B2
(45) Date of Patent: Dec. 5, 2006

(54) EXTRUDED COMPOSITE PROFILE AND METHOD FOR SEPARATELY WINDING TWO INDIVIDUAL SIMULTANEOUSLY EXTRUDED TUBES WITH THE AID OF A WINDING DEVICE

(75) Inventors: Norbert William Sucke, Duisburg (DE); Ismail Boyraz, Bochum (DE); Reiner Breindl, Hattingen (DE)

(73) Assignee: Erbsloh Aluminium GmbH, Velbert (DE)

( * ) Notice: Subject to any disclaimer, the term of this patent is extended or adjusted under 35 U.S.C. 154(b) by 68 days.

(21) Appl. No.: 10/528,325

(22) PCT Filed: Aug. 7, 2003

(86) PCT No.: PCT/EP03/08734

§ 371 (c)(1),
(2), (4) Date: Mar. 18, 2005

(87) PCT Pub. No.: WO2004/033122

PCT Pub. Date: Apr. 22, 2004

(65) Prior Publication Data

US 2005/0217340 A1 Oct. 6, 2005

(30) Foreign Application Priority Data

Sep. 20, 2002 (DE) ..... 102 43 725

(51) Int. Cl.
*B21C 35/00* (2006.01)

(52) U.S. Cl. ..... 72/257; 72/19.2; 72/254; 72/371

(58) Field of Classification Search ..... 72/18.4, 72/19.2, 19.5, 146, 148, 205, 254, 257, 371; 242/474.3, 474.4, 525, 525.1; 226/42, 44; 225/3; 29/890.053
See application file for complete search history.

(56) References Cited

U.S. PATENT DOCUMENTS 3,477,126 A * 11/1969 Price ..... 29/605

(Continued)

FOREIGN PATENT DOCUMENTS

DE 31 31 155 2/1983

(Continued)

*Primary Examiner*—Ed Tolan
(74) *Attorney, Agent, or Firm*—Friedrich Kueffner

(57) ABSTRACT

The invention relates to an extruded composite profile (10) and to method for separately winding two individual simultaneously extruded tubes (20, 30) with the aid of a winding device. The inventive extruded composite profile (10) consists of at least two individual tubes (20, 30) connected to each other with the aid of a thin binding site which makes it possible to extrude thereof in such a way that they run out from an extruder (a) at an identical velocity (v1). Said output velocity is regulated by a regulating device (D) in order to obtain a constant velocity (v2) prior to dividing the extruded composite profile (10) into said individual tubes by means of a dividing device (E) which are wound afterwards. The levelling of the tubes output velocity (v1) and the winding velocity (v3) corresponding to (v2) makes it possible to carry out a low-cost winding of several simultaneously extruded profiles.

13 Claims, 7 Drawing Sheets

U.S. PATENT DOCUMENTS

| | | | | | |
|---|---|---|---|---|---|
| 3,862,557 | A | * | 1/1975 | Zeitlin | 72/18.4 |
| 4,203,311 | A | * | 5/1980 | O'Connor et al. | 72/254 |
| 4,629,139 | A | | 12/1986 | Sanda et al. | |
| 4,789,207 | A | * | 12/1988 | Wupper | 303/113.1 |
| 5,186,244 | A | | 2/1993 | Joshi | |
| 5,755,905 | A | | 5/1998 | Sinn et al. | |
| 2002/0121120 | A1 | | 9/2002 | Kraft et al. | |

FOREIGN PATENT DOCUMENTS

| | | |
|---|---|---|
| EP | 1 208 923 | 5/2002 |
| WO | 00/23205 | 4/2000 |

* cited by examiner

FIG. 8b
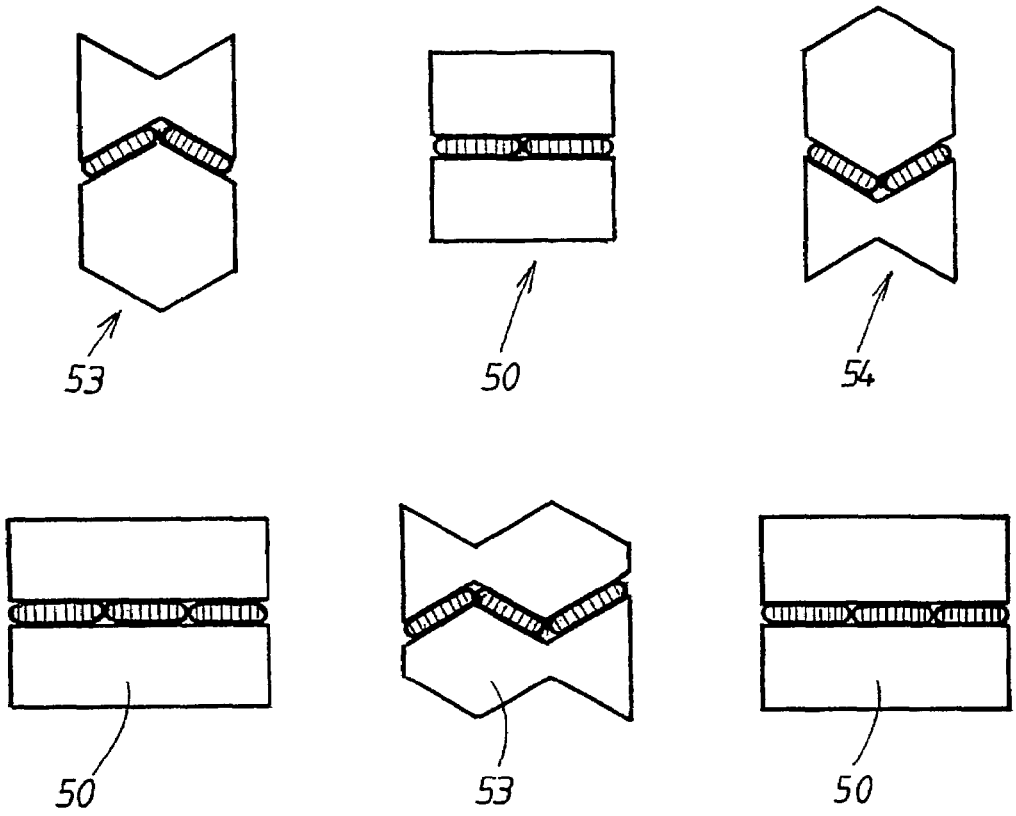
FIG. 9
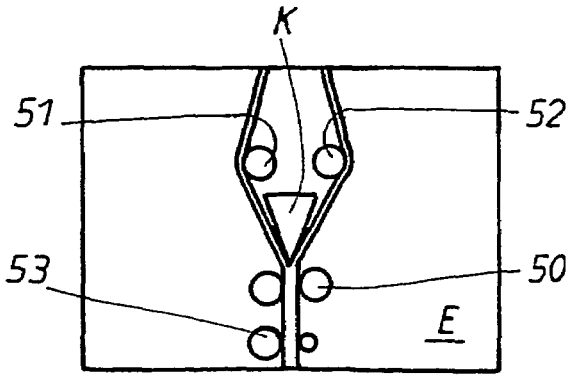
FIG. 10

EXTRUDED COMPOSITE PROFILE AND METHOD FOR SEPARATELY WINDING TWO INDIVIDUAL SIMULTANEOUSLY EXTRUDED TUBES WITH THE AID OF A WINDING DEVICE

This application is a 35 USC 371 of PCT/EP03/08734 filed Aug. 07, 2003.

The invention concerns an extruded composite profile, especially for use in a method for separately coiling two individual, simultaneously extruded tubes by means of a single coiling device.

To increase production capacity and to reduce the extrusion ratio in extruded profiles, it is well-known that multiple strands can be extruded. DE 31 31 155 C2 describes the production of a multiple extrusion of this type for use as hollow spacer sections for multipane glazings. In one embodiment, four hollow spacer profiles in the composite profile of a multiple extrusion are shown arranged parallel to one another. The connection is formed by a web, and its cross section is dimensioned in such a way that it remains dimensionally stable after leaving the extrusion die. To obtain the individual profiles, the webs are severed. For this purpose, weakening continuous notches are provided at the ends of the web wall. During the extrusion of straight lengths of these multiple strands, the latter are held by a drawing device and run to a length of typically 30 to 100 m. A quasi-continuous method for producing individual strands is not described. In a quasi-continuous method described in WO 00/23205, which involves extrusion with subsequent coiling, strand lengths of several hundred to several thousand meters are achieved. However, individual strands are generally extruded, since extrusion rate differences of the individual strands emerging from the individual die openings of the extrusion press cannot be compensated by the drawing device. Coiling several strands with one coiling device is then no longer possible due to the cumulative differences in strand length. The problem is typically solved by installing a number of independent coiling devices that corresponds to the number of die openings. This has the disadvantage of increased plant requirements. At the same time, the number of possible strands is limited due to the necessary space and die size.

The objective of the invention is to develop a method for coiling several simultaneously extruded profiles that is as cost-effective as possible.

This objective is achieved by a method in accordance with claim 1, in which an extruded composite profile is produced in a first process step. This extruded composite profile, which is extruded as a single piece, preferably is composed of aluminum or an aluminum alloy. It has at least two individual tubes, which are connected with each other by a thin, narrow junction. The individual tubes can have the same or different outside and inside geometries. In a preferred embodiment, the individual tubes have a flat profile cross section with two parallel broad sides and two convex narrow sides that join the broad sides, such that the individual tubes, which are arranged side by side, are connected with each other as a single piece by the junction in the radial region at the narrow sides. In an especially preferred composite profile, the individual tubes are connected by the junction at the radial vertex of each adjacent narrow side. Due to the connection of the individual tubes in the composite profile, the rate of extrusion of the individual strands during the extrusion process and thus the strand lengths are absolutely synchronized.

If necessary, after extrusion, the strand of the extruded composite profile can pass through a surface coating station with subsequent drying/hardening, and/or cooling. After the strand of the extruded composite profile has cooled, it passes through a speed regulation device, where said strand of the extruded composite profile is adjusted to a constant speed of passage before the connection of the individual tubes in the composite profile is severed in a separating device.

To facilitate this separation and to avoid deformation and damage of the individual tubes, the wall thickness of the junction must be smaller than the wall thicknesses of the adjacent individual tubes. It should be reduced by at least 20%. Furthermore, it was found to be advantageous for the width of the junction to be minimal, namely, 0.1 to 1.5 mm. A junction width smaller than 0.1 mm means that the walls of the individual tubes merge with each other. This necessarily leads to deformations of the walls of the individual tubes during separation. Although widths of the junction greater than 1.5 mm are possible, they are a disadvantage for the reason that after the extruded composite profile has been separated, residual material of the junction remains at the radius of the individual tubes, which forms a visible, unsightly seam and can be removed only by additional finishing work. In addition, in the case of large and relatively thick profiles, the junction can be provided with at least one predetermined breaking point, which further reduces the wall thickness of the junction.

The strands of the individual tubes can be separated in various ways, for example, by pulling them apart or breaking them apart. In the case of pulling them apart, the individual tube strands are pulled apart horizontally or vertically with respect to the arrangement of the individual tubes relative to each other. This can be realized in a separating device by the suitable arrangement of guide rollers.

In a different design, the separation operation of pulling the individual tubes apart is supported by the arrangement of a wedge-shaped tool at the separation site, so that reliable breaking apart of the junction is always effected at the same point.

In another design, the junction is not torn apart, but rather separation is effected solely by the wedge-shaped tool.

In an especially advantageous design variant, the separation is effected by single or repeated bending of the individual tubes about the junction. To carry out bending movements of this type, the strands of the extruded composite profile are guided through pairs of shaped rollers, such that the opposing shaped rollers have matching peripheral profiling, which corresponds to the desired bending deflections. If, for example, a planar extruded composite profile consisting of several individual tubes arranged side by side is being extruded, then a pair of shaped rollers that has zigzag profiling is to be used for breaking apart the junction of the individual tubes, so that a zigzag space for receiving the extruded composite profile is formed between the shaped rollers. After the formerly planar extruded composite profile has passed through the first pair of shaped rollers, the extruded composite profile, has been deformed into a zigzag cross section, in which the reversal points in the zigzag path are located at the junction. This single bending generally does not result in separation but rather causes strain hardening at the bending point due to the application of bending stress, i.e., material strengthening at the junction. This material strengthening of the junction facilitates a subsequent separation of the connection between the strands of individual tubes. It is also advantageous to employ a strain hardening step of this type in the above-described separating method involving the use of a wedge-shaped tool to pull apart or separate the individual strands.

Repeated bending back and forth then leads to the severing of the junctions between the individual tubes. Preferably, additional pairs of shaped rollers are used for this purpose, and in this case, the orientation of the upper roller and lower roller alternates in successive pairs of rollers.

In an especially preferred embodiment, a pair of cylindrically shaped rollers is arranged between each two successive pairs of shaped rollers. In this way, each pair of shaped rollers needs to carry out a maximum of one bending movement, starting from the planar extruded composite profile and bending it into a zigzag profile or, vice versa, starting from a zigzag, profile and bending it into a planar profile.

The number of bending movements needed for the separation depends on the wall thickness of the junction and on the nature of the material.

In the same way that a planar extruded composite profile can be separated into individual tubes by bending back and forth, this is also possible for an extruded composite profile with a zigzag shape or other shape.

To avoid deformation of the individual tubes during the bending operations, the individual tubes are subjected to a maximum bending deflection only as far as contact with the adjacent individual tube. The maximum upward bending angle of two individual tubes from their initial planar position is defined as the angle above the junction between the tangents that are in contact with the walls of the individual tubes, starting from the center of the junction. In the same way, the maximum downward bending angle of two individual tubes from their initial planar position is defined as the angle below the junction between the tangents that are in contact with the walls of the individual tubes, starting from the center of the junction. In the case of a connection of identical individual tubes at the radial vertex, the two bending angles have the same measure.

After the individual strands have been separated, they are guided apart and wound in separate winding regions, and these separate winding regions on one or more coils are driven by the drive of a coiling device. This means that only one coiling device is necessary, and thus the capital costs for an installation of this type can be kept at a low level.

Further details and advantages of the invention are specified in the dependent claims and in the following description of embodiments of the invention. However, the invention is not limited to these specific embodiments.

Figure 8A:
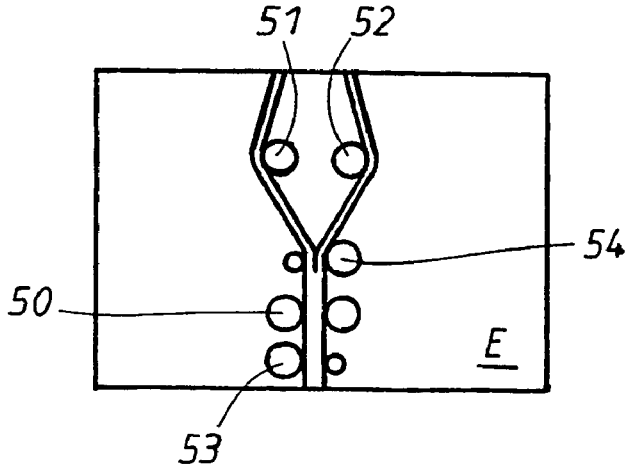

FIG. 8*a* shows a schematic drawing of another separating device.

FIG. 8*b* shows a sectional view of the respective pairs of rollers from FIG. 8*a*.

FIG. 9 shows a sectional view of other pairs of rollers.

FIG. 10 shows a schematic drawing of another separating device.

Figure 11:
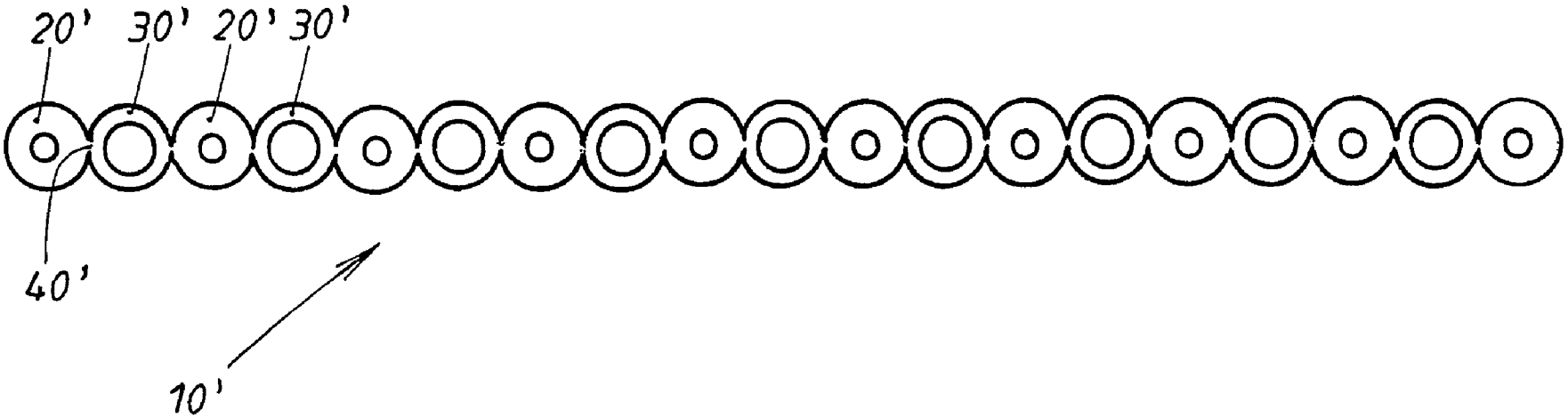

FIG. 11 shows a sectional view of another composite profile.

Figure 1:
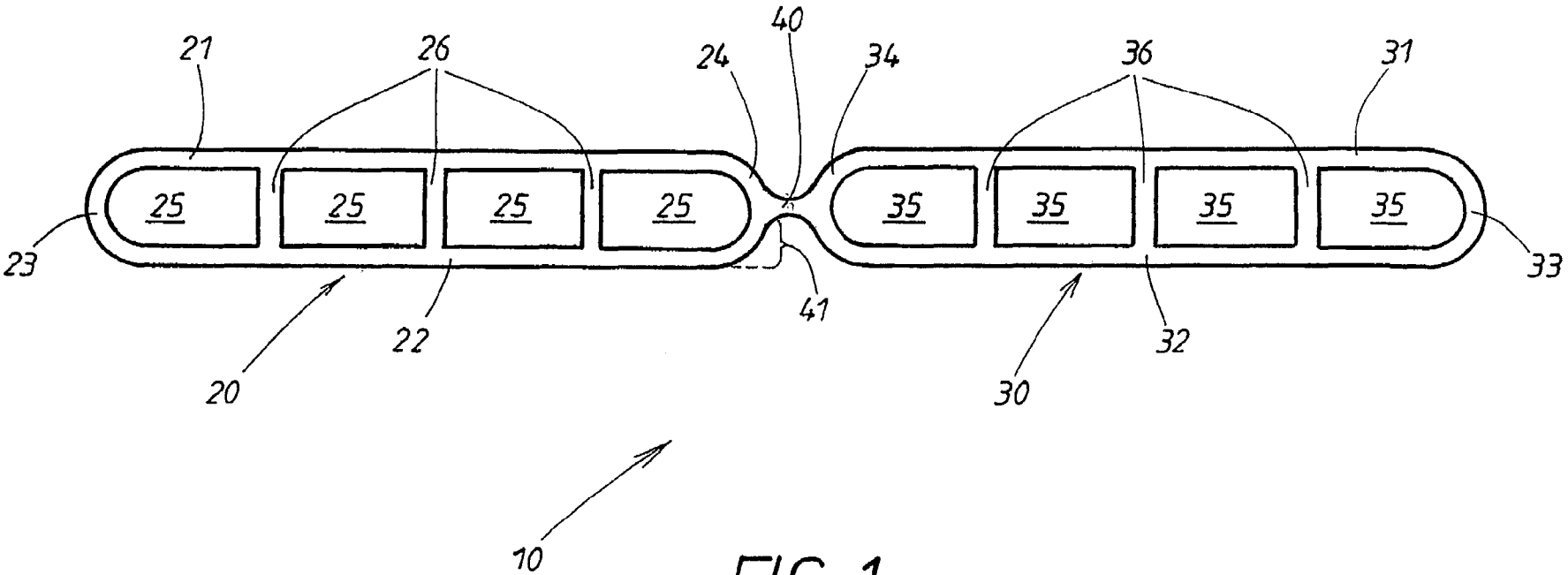
FIG. 1 shows a sectional view of an extruded composite profile.
Figure 4:
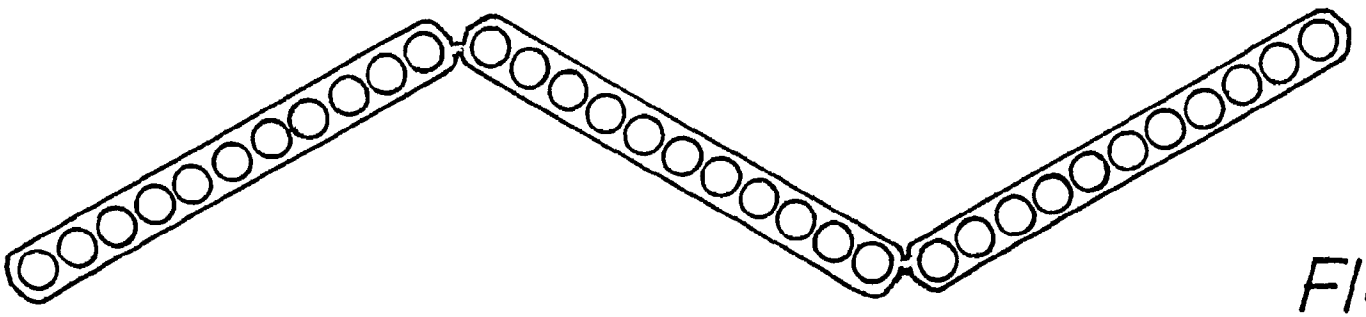
FIG. 4 shows a sectional view of a zigzag-extruded composite profile.

FIG. 1 shows the cross section of the extruded composite profile 10 obtained by extrusion. This composite profile 10 consists of two individual tubes 20, 30, each of which has a flat profile cross section with two parallel broad sides 21, 22 and 31, 32 and two convex narrow sides 23, 24 and 33, 34 that join the broad sides. The individual tubes 20, 30 are arranged side by side in the extruded composite profile 10 and are joined at their narrow sides 24, 34 by a junction 40. Naturally, it is also conceivable for more than two individual tubes to be joined, with each two adjacent individual tubes joined by a junction 40. Furthermore, the narrow sides 23, 24 and 33, 34, which join the broad sides 21, 22 and 31, 32, can also have a flat design. The individual tubes 20, 30 have the same outside and inside geometry in this embodiment. The individual tubes 20, 30 can also have different outside and inside geometries. As a rule, however, the height of the individual tubes 20, 30 will be the same, and preferably only the width and the inside geometry of the individual tubes 20, 30 will vary. Each of the individual tubes 20, 30 has four channels 25, 35, which are separated from each other by channel walls 26, 36. Another possible inside geometry of the individual tubes is shown in FIG. 4.

The individual tubes 20, 30 do not have to have a flat profile cross section. Other cross-sectional shapes are also possible, such as circular or oval individual tubes. FIG. 11 shows a composite profile 10', which has individual tubes 20', 30' alternately arranged side by side and interconnected by junctions 40'. The outside diameter of all of the individual tubes 20', 30' is the same, but the inside diameters are different. A composite profile 10' of this type is suitable for the passage of different media. For example, it can be used as an internal heat exchanger in motor vehicles. The composite profile 10' can be separated between each individual tube 20', 30', or only selected junctions 40' are separated to obtain a desired width of the composite profile.

A further advantage of a composite profile of this type is that when the composite profile is installed in the motor vehicle, and the individual tubes 20', 30' are connected to the connectors provided for this purpose, the individual tubes 20', 30' that are still connected can, if necessary, be separated over a certain length by separation of the given junctions 40', while in other areas the connection between the individual tubes 20', 30' in the composite profile can be preserved.

Figure 2:
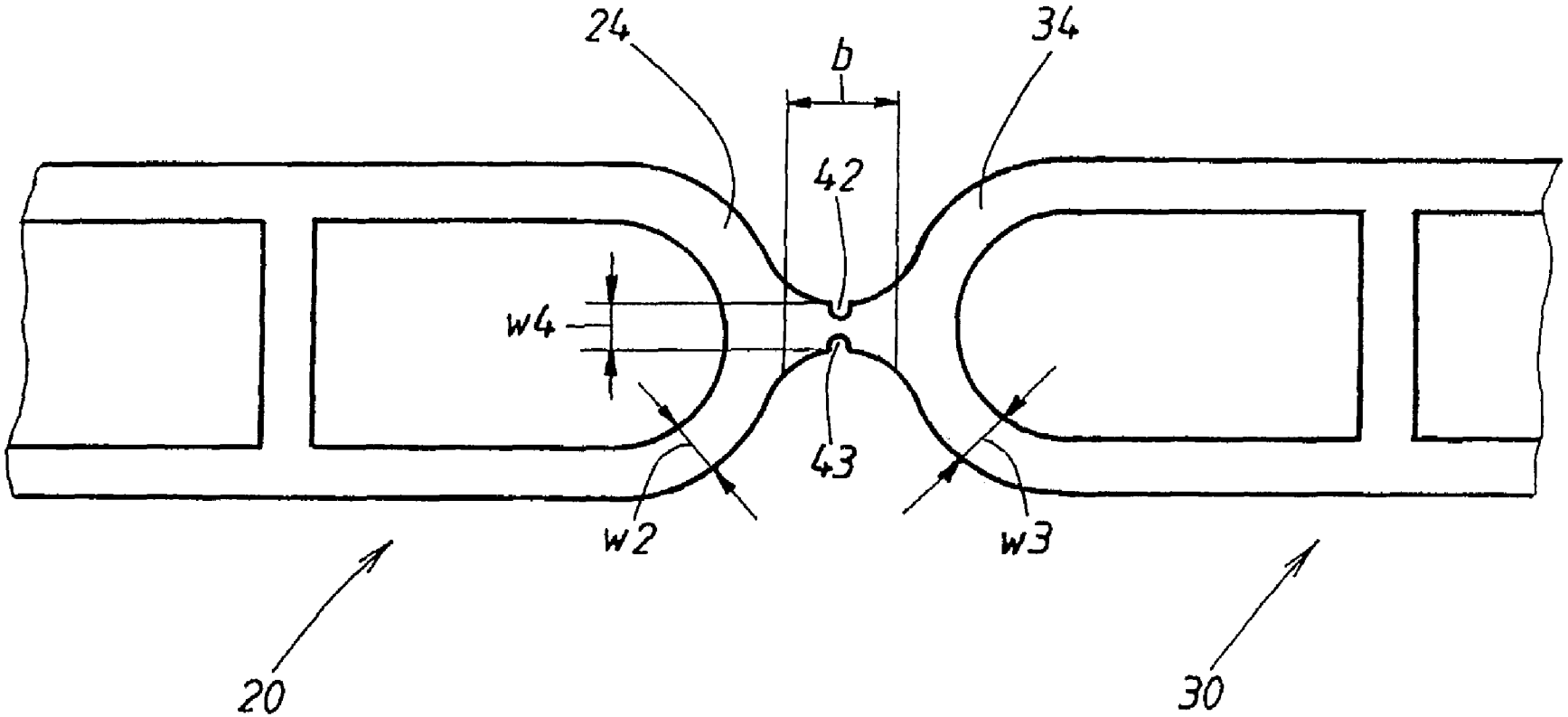
FIG. 2 shows an enlarged sector of the sectional view of the extruded composite profile according to FIG. 1.

In the embodiment shown in FIGS. 1 and 2, the wall of the individual tubes 20, 30 has a uniform thickness. To achieve unproblematic and clean separation of the individual tubes 20, 30, it is advantageous if the wall thickness w2 of the narrow side 24 and the wall thickness w3 of the narrow side 34, which is connected with the narrow side 24 by the junction 40, are greater than the wall thickness w4 of the junction 40. Preferably, the wall thickness w4 of the junction 40 should be at least 20% less than the wall thicknesses w2 and w3 of the adjacent narrow sides 24, 34. The width b of the junction 40 should be selected as small as possible; the width b of the junction 40 is preferably 0.1 to 1.5 mm, and widths b of 0.1 to 0.5 mm are especially preferred. Larger widths b of the junction 40 are possible, but they are attended by the disadvantage that, when the junction 40 is severed approximately in the middle, an unnecessarily large amount of material remains at the radius of the individual profiles 20, 30. Individual tubes 20, 30 of this type with rough excess material at the radius must be smoothed in an additional process step, for example, by means of rollers, sliding blocks, or scraping blades. The thin and narrow junction 40 is generally separated in the middle during the separation of the individual tubes 20, 30.

In the case of profiles and junctions with thicker walls, it is advantageous to provide the junctions 40 with one or two predetermined breaking points 42, 43, which are then preferably located in the center of the junction 40 and opposite each other. In FIGS. 1 and 2, the junction is set back by a shoulder 41, so that the individual tubes 20, 30 are joined in the radial region.

Figure 3:
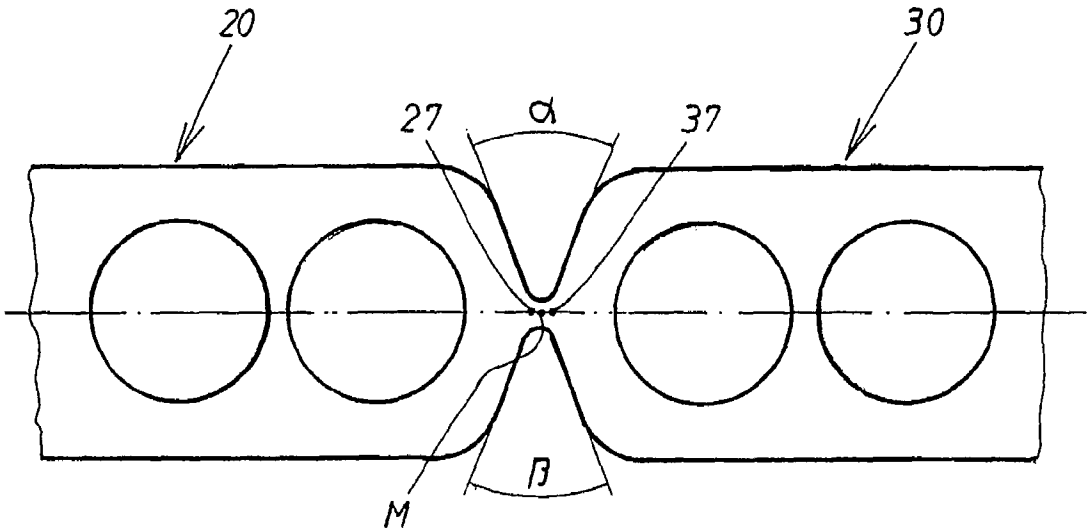
FIG. 3 shows an enlarged sector of the cross section of another extruded composite profile.

FIG. 3 shows another composite profile, which has individual tubes 20, 30 with parallel broad sides and convex narrow sides. The junction 40 extends from the radial vertex 27 of the individual tube 20 to the radial vertex 37 of the individual tube 30.

In FIG. 4, an extruded composite profile is composed of three individual tubes, in which the individual tubes are not extruded sides by side in a single plane, but rather the composite profile has a zigzag cross section. The individual tubes are joined in this composite profile by the junction in the radial region but not absolutely at each radial vertex.

Figure 5:
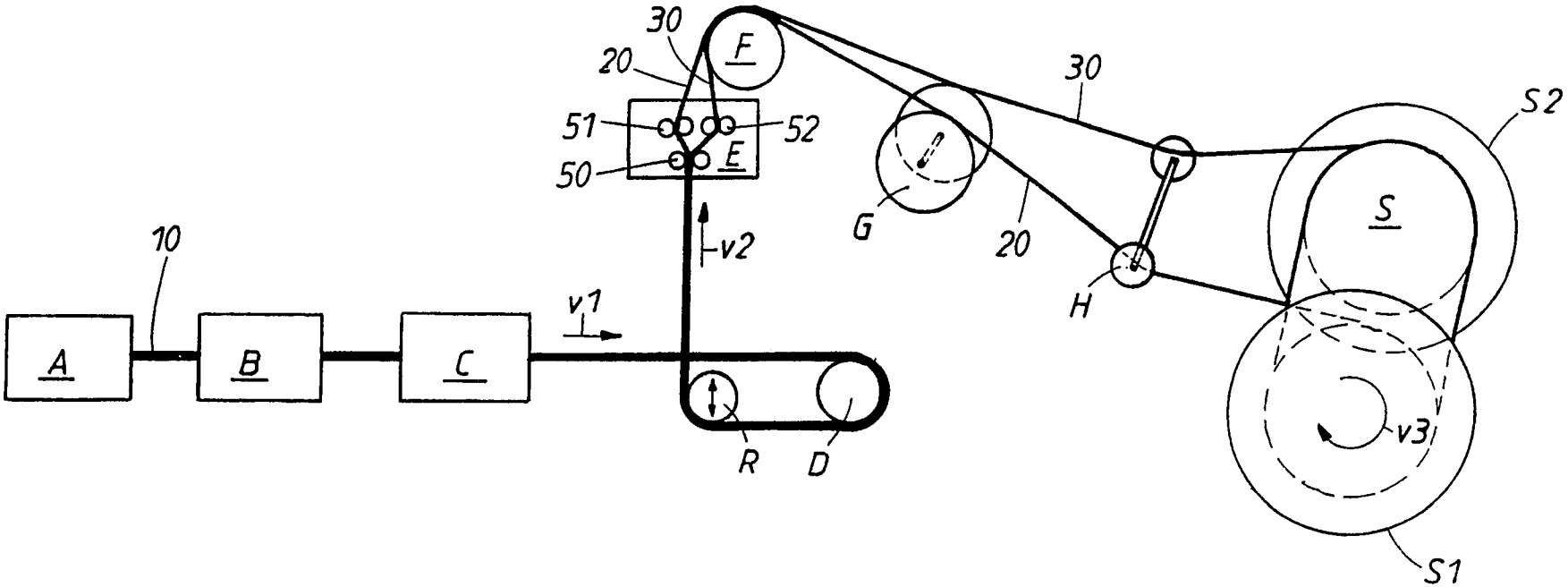
FIG. 5 shows a schematic drawing of one possible embodiment of the method of the invention.

Depending on the intended application, as FIG. 5 shows, the extruded composite profiles 10 described above can be coated in a processing step (B) after they have left the extrusion die of the extrusion press (A), e.g., with a coating of zinc, flux, or solder. If a coating (B) of this type is provided, the composite profile 10 generally passes through a drying device (C). FIG. 5 shows a schematic drawing of the production method. The composite profile 10 leaves the extrusion press (A) at a strand exit speed (v1). If necessary, it passes through a coating device (B) and then a drying or cooling device (C). The extruded composite profile 10 is then fed into a speed regulation device (D), in which the strand exit speed (v1) of the extruded composite profile 10 from the extrusion press and the speed (v3) of the coiling device (S) are equalized, i.e., the composite profile 10 leaves the speed regulation device (D) at a uniform speed (v2) that matches the speed (v3) of the coiling device (S). In this case, the speeds are equalized by means of a dancer device, i.e., by means of two rollers, at least one of which (R) can move relative to the second roller. This roller (R) can thus lengthen the distance that the composite profile 10 travels in the dancer device (D) and thus effect a reduction of its speed. Alternatively, other speed regulation devices (D) can also be used; specifically, it is possible to regulate the speed by tensile load control, for example, so-called torque control.

As FIG. 5 shows, the composite profile 10 exiting the dancer device (D) at a uniform speed (v2) then enters a separating device (E). In the separating device in FIG. 5, the composite profile 10 is pulled apart to form two separate strands of individual tubes 20, 30. This pulling apart of the composite profile 10 can be effected by horizontal zipper-like opening of the connection between the two adjacently arranged strands of the individual tubes 20, 30 at the junction 40. In this case, the individual tubes 20, 30 are moved laterally apart from each other. However, vertical opening of the connection between the two adjacently arranged strands of the individual tubes 20, 30 at the junction is also possible. In this case, one strand, for example, individual tube 20, is moved upward, and the other strand, for example, individual tube 30, is moved downward. However, it is also possible for only one strand, for example, individual tube 20, to be moved away from the composite profile 10. In FIG. 5, this is realized in such a way that the strand of composite profile 10 is picked up by a pair of guide rollers 50 and then pulled apart. This operation of pulling the strands apart is supported by two additional pairs of guide rollers 51, 52, which hold the individual strands of the individual tubes 20, 30 in the separated position and then guide them out of the separating device (E).

Figure 6:
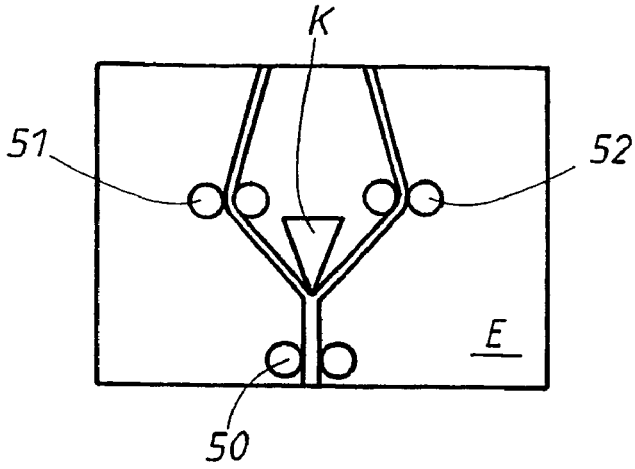
FIG. 6 shows a schematic drawing of a separating device.

FIG. 6 shows another arrangement for a separating device (E). In addition to the guide rollers 50, 51, 52, a wedge-shaped tool K is provided, which is arranged between the first pair of guide rollers 50 and the pairs of guide rollers 51, 52 that are provided for pulling the strands apart. This wedge-shaped tool K supports the uniform breaking open of the connection between the individual tubes 20, 30.

Figure 7:
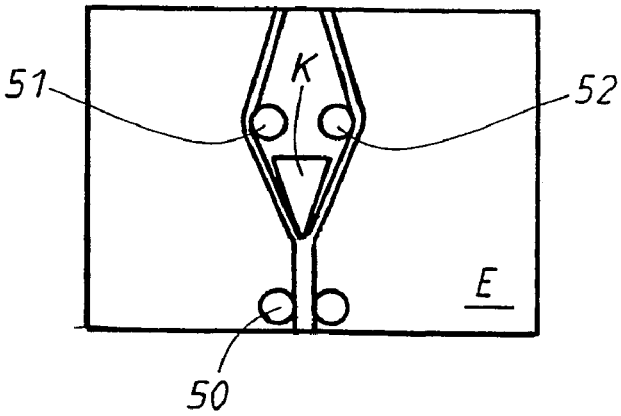
FIG. 7 shows a schematic drawing of another separating device.

The severing of the junction 40 can also be accomplished exclusively by the tool K, as FIG. 7 illustrates. In this case, the guide rollers 51, 52 serve only to guide the strands of the individual tubes 20, 30 out of the separating device.

However, for a continuous process, the embodiments according to FIGS. 6 and 7 have the disadvantage that the wedge-shaped tool K wears relatively fast and must be replaced. A more advantageous separating device (E) is one in which the strands of the composite profile 10 are separated by bending. To this end, as FIGS. 8*a* and 8*b* show, the planar composite profile strand 10 is guided by different pairs of rollers 53, 50, 54. In the embodiment shown in FIG. 8*a*, the composite profile 10 is one of the type illustrated in FIG. 1, in which two individual tubes 20, 30 are arranged side by side in a plane and are connected by the junction 40. In the first pair of rollers 53, the formerly planar composite profile 10 is bent about the junction 40 until the wall of the individual tube 20 almost touches the wall of the individual tube 30. For this purpose, matching peripheral profiling is provided in the shaped rollers. As shown in FIG. 8*b*, the upper-wedge-shaped profile roller of 53 has a central, concave, triangular indentation, and the lower roller has a corresponding convex, triangular projection. The separation of the rollers corresponds approximately to the height of the composite profile or the heights of the individual tubes. The concave indentation and the convex projection produce the desired bending deflection of the individual tubes 20, 30 about the junction 40, such that the junction 40 is positioned at the vertex of the triangular indentation and projection. Deformation of the individual tubes 20, 30 during the bending deformation is avoided by virtue of the fact that the profilings of the pair of shaped rollers 53 and of the following pairs of shaped rollers, for example, 54, allow only bending movements that are smaller than the maximum bending angles $\alpha$ and $\beta$ for the composite profile 10. These maximum bending angles $\alpha$, $\beta$ for a composite profile are shown in FIG. 3. They are obtained by drawing tangents to the individual tubes 20 and 30 above and below the junction 40, starting from the center M of the junction 40. The maximum bending angle $\alpha$ is obtained above the junction 40. When the individual tubes 20, 30 of the planar composite profile 10 are subjected to a bending movement towards each other above the junction, the individual tubes 20, 30 touch each other when they are bent by the bending angle $\alpha$. If they are bent by a larger bending angle, the walls of the individual tubes are subjected to unwanted deformation. Accordingly, the shaped rollers may allow bending only up to the maximum bending angle $\alpha$ or $\beta$. In the example shown in FIG. 8, in the case of the pair of shaped rollers 53, the bending angle $\beta$ was taken into account for the downwardly directed bending, and in the case of the pair of shaped rollers 54, the maximum bending angle $\alpha$ was taken into account for the upwardly directed bending. As FIG. 8*b* shows, identical pairs of shaped rollers can be used for the differently directed bendings, but they are alternately installed in the separating device with opposite orientations with respect to the composite profile. Thus, the upper roller of the pair of shaped rollers 53 is the same as the lower roller of the pair of shaped rollers 54, and the same is true of each opposing roller.

A single bending generally does not cause separation of the junctions 40, so that it is necessary to bend the strands back and forth several times. It has been found to be advantageous to provide a pair of cylindrical rollers 50 between two pairs of profiled shaped rollers 53, 54. This facilitates the guiding of the strand of the composite profile 10 in the separating device (E). FIG. 8*a* shows a total of 3 pairs of rollers 53, 50, 54. The number of bending stations in the separating device (E) can be increased as desired.

In the case of very small bending deflections, a comparatively larger number of bending steps is necessary that in the case of larger bending deflections.

Composite profiles of the type shown in FIG. 4 can also be separated with a bending separating device of this type. The extruded composite profile shown in FIG. 4 already has a zigzag cross section. In this case, the first bending step can be selected in such a way that a planar composite profile is obtained after the first bending. Possible pairs of rollers for this are shown in FIG. 9. In the first step, a pair of cylindrical rollers 50 is used to produce a planar profile from the zigzag profile. This is followed by a pair of shaped rollers 53 with zigzag profiling, and then the bent composite profile is again bent into a planar composite profile in a pair of cylindrical rollers 50. This can be followed by additional pairs of rollers until the composite profile has been separated into individual strands.

It has been found that even only one bending is very advantageous for the separation, since the bending deformation leads to embrittlement at the junction. This type of material strengthening of the junction can also be advantageous in the above-described methods in accordance with FIGS. 5 to 7. FIG. 10 shows the method of FIG. 7 but with an initial bending step, i.e., the use of a bending device is combined with the use of a wedge-shaped tool K. A pair of cylindrical rollers 50 is provided between the pair of shaped rollers 53 and the tool K to ensure correct positioning of the profile for the application of force by the wedge-shaped tool K.

The individual strands of the individual tubes 20 and 30 are then further conveyed separately. As FIG. 3 shows, the individual tube strands 20, 30 are conveyed by rollers (F) and (G) and then by displacing arms (H) towards the coiling device (S). The speed of the individual tube strands is still the speed (v2) of the composite profile before the separating device (E). The individual tube strands 20, 30 arrive at the coiling device (S) from the separating device (E) without plastic deformation. Each strand is separately coiled on a coil in the coiling station (S). In FIG. 3, the strand of individual tube 20 is wound on coil (S1), and the strand 30 of the individual tube 30 is wound on coil (S2). The coils (S1) and (S2) are part of a coiling device (S), and in this case they are arranged side by side. They are driven at a constant speed (v3) by a drive (not shown here). This speed (v3) of the coils (S1, S2) is equal to the speed (v2) of the individual strands 20, 30 before the coiling device (S). The individual coils (S1, S2) can be arranged side by side, as shown in the drawing, or they can be arranged one above the other. Furthermore, it is possible to use only one coil, in which case the individual strands to be wound are assigned to different winding regions of the coil.

In the embodiment shown in FIG. 5, the composite profile 10 is indicated by a somewhat bolder line. The individual strands 20, 30 that are formed after the separating device (E) are indicated by thinner lines to distinguish them from the unseparated composite profile. The total process shown in FIG. 3 for the separate coiling of two individual, simultaneously extruded tubes 20, 30 by means of a single coiling device (S) is one embodiment of the method.

It is, also possible to produce more than two strands in this way. Furthermore, it is possible to dispense with a coating of the composite profile in the coating device (B).

It is also possible to coil the composite profile 10 temporarily and then to uncoil it at a later time or, for example, to uncoil it in a different location after it has been shipped to a composite profile processor. In this case, the composite profile 10 emerging from the extrusion press (A) is wound on a coil, if necessary, after a coating and drying operation. The composite profile profile 10 is then uncoiled later and fed into a separating device (E). The separated strands are each fed separately to a coil of a coiling device.

Both methods are more cost-effective than previous methods.

List of Reference Numbers

| | |
|---|---|
| 10, 10' | composite profile |
| 20, 20' | individual tube |
| 21 | broad side |
| 22 | broad side |
| 23 | narrow side |
| 24 | narrow side |
| 25 | channel |
| 26 | channel wall |
| 27 | radial vertex |
| 30, 30' | individual tube |
| 31 | broad side |
| 32 | broad side |
| 33 | narrow side |
| 34 | narrow side |
| 35 | channel |
| 36 | channel wall |
| 37 | radial vertex |
| 40, 40' | junction |
| 41 | shoulder |
| 42 | predetermined breaking point |
| 43 | predetermined breaking point |
| 50 | guide roller |
| 51 | guide roller |
| 52 | guide roller |
| 53 | pair of shaped rollers |
| 54 | pair of shaped rollers |
| A | extrusion press |
| B | surface coating |
| C | drying/cooling |
| D | speed regulation device |
| E | separating device |
| F | roller |
| G | roller |
| H | displacing arm |
| K | wedge |
| M | center of the junction 40 |
| R | roller |
| S | coiling device |
| S1 | coil |
| S2 | coil |
| b | width of 40 |
| w2 | wall thickness of 23, 24 |
| w3 | wall thickness of 33, 34 |
| w4 | wall thickness of 40 |
| v1 | strand exit speed of 10 |
| v2 | strand speed after D |
| v3 | coiling speed |
| α | maximum bending angle |
| β | maximum bending angle |

The invention claimed is:

1. Method for producing and separately coiling at least two individual, simultaneously extruded tubes (20, 30) by means of a single coiling device, said method comprising extrusion of a strand of a composite profile (10) comprising at least two individual tubes (20, 30) of the same or different outside and inside geometries, such that the individual tubes (20, 30), which are arranged side by side, are connected with each other by a junction (40) of minimal width, feeding the strand of the composite profile (10) emerging from the extrusion press (A) at a strand exit speed (v1) into a speed regulation device (D), in which the strand of the composite profile (10) is adjusted to a speed (v2), then, to produce separate strands of the individual tubes (20, 30), separation of the junctions (40) of the strand of the composite profile (10) in the longitudinal direction of the composite profile (10) in a separating device (E), and then feeding the strands of the individual tubes (20, 30) separately at unaltered speed (v2) to a coiling device (S), in which the strands of the individual tubes (20, 30) are each wound separately on a coil (S1, S2), such that the two coils (S1, S2) of the coiling device (S) are moved by a common drive at a coiling speed (v3) that is equal to the speed (v2).

2. Method in accordance with claim 1, wherein the strand of the composite profile (10) emerging from the extrusion press (A) passes through a surface coating station (B). and then a drying/hardening and/or cooling station (C) before being fed into a speed regulation device (D), such that the surface coating (B) preferably consists of a zinc coating and/or a solder coating and/or a flux coating.

3. Method in accordance with claim 1, wherein the strand of the composite profile (10) emerging from the extrusion-.press (A) or the coated and/or cooled strand is temporarily coiled on a coil and is uncoiled at a later time or in a different location and then fed into a separating device (E).

4. Method in accordance with claim 1, wherein the speed regulation device (D) is a dancer device or a torque control device.

5. Method in accordance with claim 1, wherein the strand of the single-piece composite profile (10) is pulled apart in the separating device (E) by horizontal zipper-like opening or by vertical opening of the connection between the adjacently arranged strands of the individual tubes (20, 30) at the junction (40).

6. Method in accordance with claim 1, wherein the strand of the single-piece composite profile (10) is broken apart in the separating device (E) by bending the two adjacently arranged strands of the individual tubes (20, 30) about the center (M) of the junction (40).

7. Method in accordance with claim 6, wherein the strand is broken apart by repeated bending by means of shaped rollers (R), and that the bending is limited to maximum bending angles (a, b).

8. Method in accordance with claim 1, wherein the separation of the strand in the separating device (E) is effected solely by a wedge-shaped tool (K) or is additionally assisted by said tool.

9. Method in accordance with claim 1, wherein before it is fed into the separating device (E), the strand of the composite profile (10) is subjected to material strengthening, which preferably involves strain hardening by the application of bending stress or tensile stress.

10. Method in accordance with claim 1, wherein the individual tube strands (20, 30) are separately fed by rollers (F, G) and displacing arms (H) to the coiling device (S) at unaltered speed (v2) and without plastic deformation.

11. Method in accordance with claim 1, wherein the individual tube strands (20, 30) are each separately wound at unaltered speed (v2) on a coil (S1, S2), said coils (S1, S2) of the coiling device (S) being arranged side by side or one above the other.

12. Method in accordance with claim 1, wherein the individual tube strands (20, 30) are separately wound at unaltered speed (v2) on different winding regions of one coil.

13. Method in accordance with claim 1, wherein the fin formed on the individual tube strands (20, 30) by the separation of the strand of the composite profile (10), is smoothed by rollers or sliding blocks or scraping blades.

* * * * *